US008505349B2

(12) United States Patent
Golovashchenko

(10) Patent No.: US 8,505,349 B2
(45) Date of Patent: Aug. 13, 2013

(54) METHOD AND APPARATUS FOR HYDRO-FORMING AN ELONGATED TUBULAR MEMBER

(75) Inventor: Sergey Fedorovich Golovashchenko, Beverly Hills, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 190 days.

(21) Appl. No.: 13/105,458

(22) Filed: May 11, 2011

(65) Prior Publication Data

US 2012/0285213 A1 Nov. 15, 2012

(51) Int. Cl.
*B21D 26/02* (2011.01)
*B21D 39/08* (2006.01)

(52) U.S. Cl.
USPC ..... 72/58; 72/62; 72/370.23; 29/421.1

(58) Field of Classification Search
USPC ..... 72/58, 60, 61, 62, 370.23; 29/421.1
See application file for complete search history.

(56) References Cited

U.S. PATENT DOCUMENTS

| | | | | |
|---|---|---|---|---|
| 5,339,667 | A | 8/1994 | Shah et al. | |
| 6,032,501 | A | 3/2000 | Bihrer | |
| 6,098,438 | A * | 8/2000 | Fischer | 72/60 |
| 6,134,931 | A | 10/2000 | Glaesener | |
| 6,151,940 | A * | 11/2000 | Amborn et al. | 72/62 |
| 6,752,451 | B2 * | 6/2004 | Sakamoto et al. | 72/370.23 |
| 6,763,693 | B1 * | 7/2004 | Gehrig et al. | 72/61 |
| 6,810,705 | B1 * | 11/2004 | Leppin et al. | 72/61 |
| 2006/0123875 | A1 | 6/2006 | Oxley et al. | |
| 2010/0024503 | A1 * | 2/2010 | Bradley et al. | 72/61 |
| 2011/0097596 | A1 * | 4/2011 | Mizumura et al. | 72/56 |

OTHER PUBLICATIONS

F.J. Ripodas Agudo, Aceralia Tubes (*Aceralia transformados*), Arcelor Group & Professor of Manufacturing Technologies, Universidad Publica de Navarra, Spain, Manufacturing Tubes for Hydroforming Applications, May/Jun. 2003.

Z.Y. Shen, M.N. James, W.D. Li, and Y.X. Zhao, Reduction of Friction and Calibration Pressure by Section Preform during Hydroforming of Tubular Automotive Structural Components, Advanced Materials Research, vols. 44-46), Materials and Product Technologies, Cong Han et al., 2008.

Mikhail Sorine, Formability of Advanced High Strength Steel Tubes in Tube Bending and Hydroforming, A thesis to the University of Waterloo in fulfillment of the thesis requirement for the degree of Applied Science in Mechanical Engineering, Waterloo, Ontario, Canada, 2007.

* cited by examiner

*Primary Examiner* — David B Jones
(74) *Attorney, Agent, or Firm* — Damian Porcari; Brooks Kushman P.C.

(57) ABSTRACT

A method of hydro-forming an elongated tubular member that has areas of predicted high strain and areas of predicted low strain. The tubular member is initially deformed into a preliminary preform shape by compression in a preform die. Metal in the areas of predicted low strain is stretched during the preforming process by radially deforming the tube between two halves of the preform die. The preliminary preform is then expanded with internal hydro-forming pressure to form a preformed tube. The preformed tube is then hydroformed into a final die to form the final shape for the part. The extra metal in the areas of low strain is stretched into the areas of high strain in the final hydro-forming operation.

16 Claims, 4 Drawing Sheets

METHOD AND APPARATUS FOR HYDRO-FORMING AN ELONGATED TUBULAR MEMBER

TECHNICAL FIELD

This disclosure relates to method of hydro-forming a tubular member and a method of designing a die set for hydro-forming a tube.

BACKGROUND

It is a challenge to Hydro-form lightweight material such as aluminum or high strength steel in an effort to minimize the weight of the finished part. Hydro-formed parts may have areas of maximum strain that limit formability. If the maximum strength of a part is exceeded in a local area, the part may split. While strain may be maximized in certain localized areas, other areas of the hydro-formed part may have relatively low levels of strain. Corners and other highly formed areas are often located adjacent to areas where maximum strain is typically observed. Areas of maximum strain may also be adjacent to areas of lower levels of strain.

To avoid splitting in areas of high strain, more ductile materials having lower strength may be used. To provide the required strength, thicker tubes may be specified to provide the required strength. Thicker panels result in thicker parts and increase the weight of the final part. The use of thicker tubes also tends to increase material costs. Increased part weight reduces fuel economy. Hydro-formed parts may be formed in square, hexagonal or irregular shapes that include corners. If a part has corners, maximum strain may be predicted to be observed in narrow areas that are adjacent to the corners of the finished part.

Applicant has attempted to address the above challenges that tend to reduce the range of parts that may be made from lightweight material as summarized below.

SUMMARY

According to one aspect of the hydro-forming process disclosed in this application, a hydro-formed tube may be preformed to redistribute the strains in the tube and reduce the strain in areas of predicted maximum strain. By preforming the tube in areas of reduced strain that are not significantly stretched during the hydro-forming process, additional material can be provided in the areas adjacent to corners that are predicted to have maximum strain. Stretching and thinning of the tube in areas of maximum strain may be minimized by providing additional material in the preforming step in areas that have reduced strain that are adjacent to areas of maximum strain.

The process of designing a hydro-forming die for preforming and forming the tube may begin by mapping the strain distribution predicted for a one-step hydro-forming process. A finite element mesh of the tube may be used to identify areas of intensive stretching in the tube if it were to be formed in a one-step hydro-forming operation. A preformed shape is defined by identifying "windows" or areas of the tube that are not areas of substantial elongation or maximum strain. Material is available in these windows that may flow about the tube until strains in the tube are balanced. The tube is preformed in a preforming die in windows where the material of the tube is compressed. The tube is then pressurized to form the tube into a preform shape in a hydro-forming process in which fluid within the tube is pressurized by the internal pressure of the liquid. The tube is then moved to a final shape hydro-forming die where it is formed to its desired shape.

These and other features of Applicant's development will be better understood in view of the attached drawings and the following detailed description of the illustrated embodiments.

DETAILED DESCRIPTION

A detailed description of the illustrated embodiments of the present invention is provided below. The disclosed embodiments are examples of the invention that may be embodied in various and alternative forms. The figures are not necessarily to scale. Some features may be exaggerated or minimized to show details of particular components. The specific structural and function details disclosed in this application are not to be interpreted as limiting, but merely as a representative basis for teaching one skilled in the art how to practice the invention.

Figure 1:
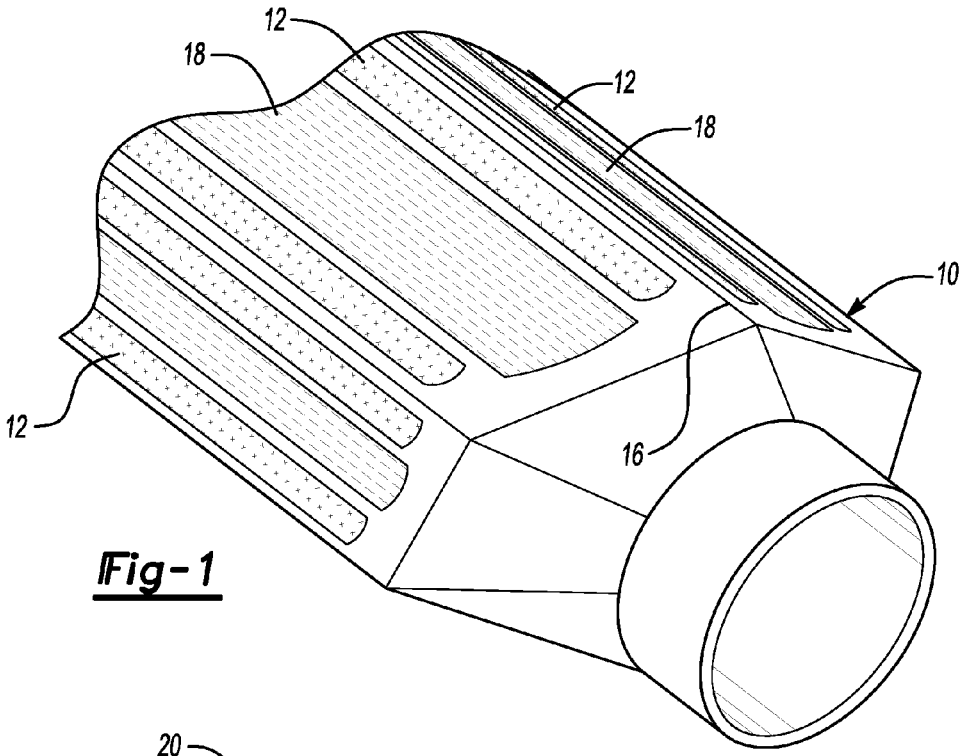
FIG. 1 is a fragmentary, diagrammatic perspective view of a hydro-formed tube having corners that illustrate the problem encountered in the prior art of thinning in areas of maximum strain adjacent to corners of the part.

Referring to FIG. 1, a hydro-formed tubular member 10 having an irregular cross section is illustrated. The tubular member 10 has a plurality of predicted areas of high strain 12 (or areas of over-stretching) are generally located closely adjacent to a corner 16 of the tubular member 10. Windows of predicted areas of low strain 18 (or areas of under-stretching) are shown generally on the side wall portions between the predicted areas of high strain 12. According to one of the methods disclosed herein, a tubular member 10 is subjected to a one-step hydro-forming operation or is simulated to be formed in a one-step hydro-forming operation. A model of the tubular member 10 may be developed and data is collected that corresponds to the distribution of strains in the tube after forming in a modeled, or actual, single step hydro-forming process.

Figure 2:
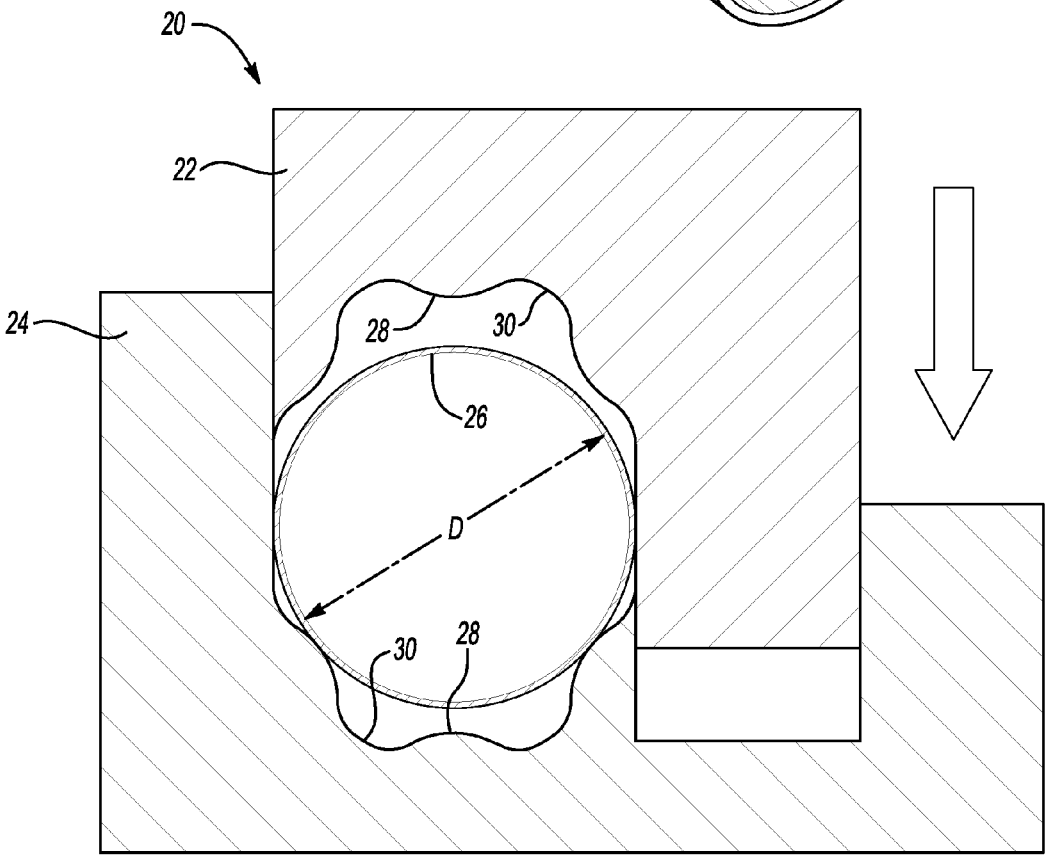
FIG. 2 is a diagrammatic cross-sectional view of a tube disposed in a preforming die at the beginning of the preforming process.

Referring to FIG. 2, a preformed die set 20 is shown to include a punch 22 and a lower die 24. A cylindrical tube 26 having a diameter D is shown in the preformed die set 20 prior to being compressed in the die set. A plurality of convex nodes 28 extend radially inwardly toward the center of the cylindrical tube and are adapted to compress the walls of the tube. A plurality of concave nodes 30 are provided between the convex nodes 28. As used herein, the terms convex and concave should be construed to refer to the shape of the surface relative to the interior surface of the die set 20. The concave nodes 30 are designed to be provided in an area corresponding to the predicted areas of high strain 12 as shown in FIG. 1. The convex nodes 28 are provided in areas that correspond to the windows of predicted low strain 18 as shown in FIG. 1.

Figure 3:
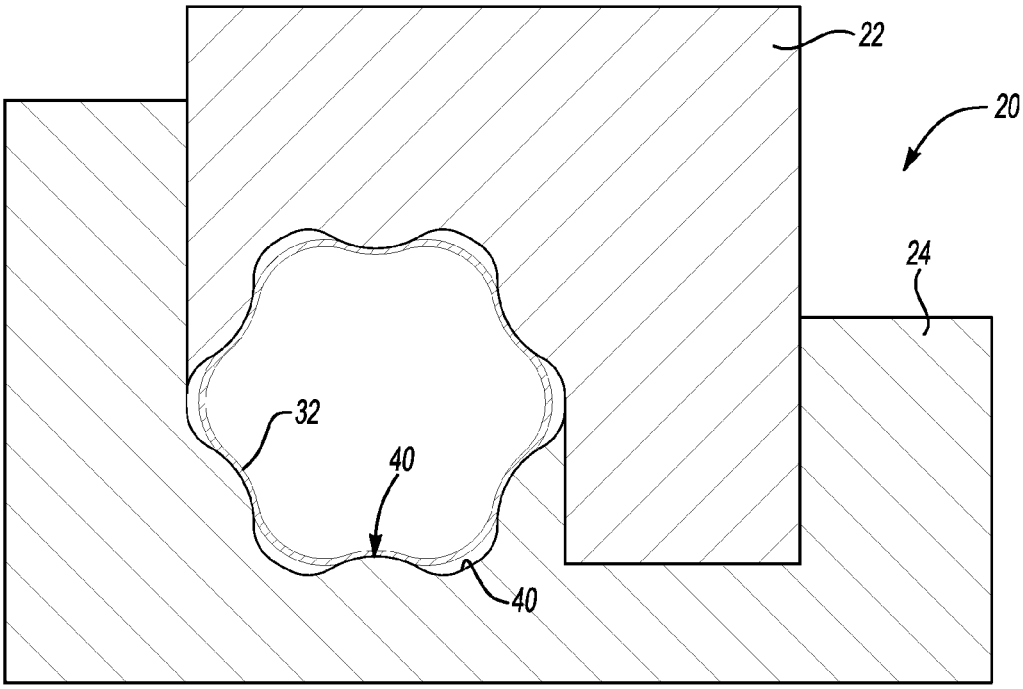
FIG. 3 is a diagrammatic cross-sectional view of a preforming die showing a tube that is deformed in local areas to create a preliminary preform.

Referring to FIG. 3, a preliminary preform 32 is formed by the preform die set 20 as it initially compresses the cylindrical tube 26 shown in FIG. 2.

Figure 4:
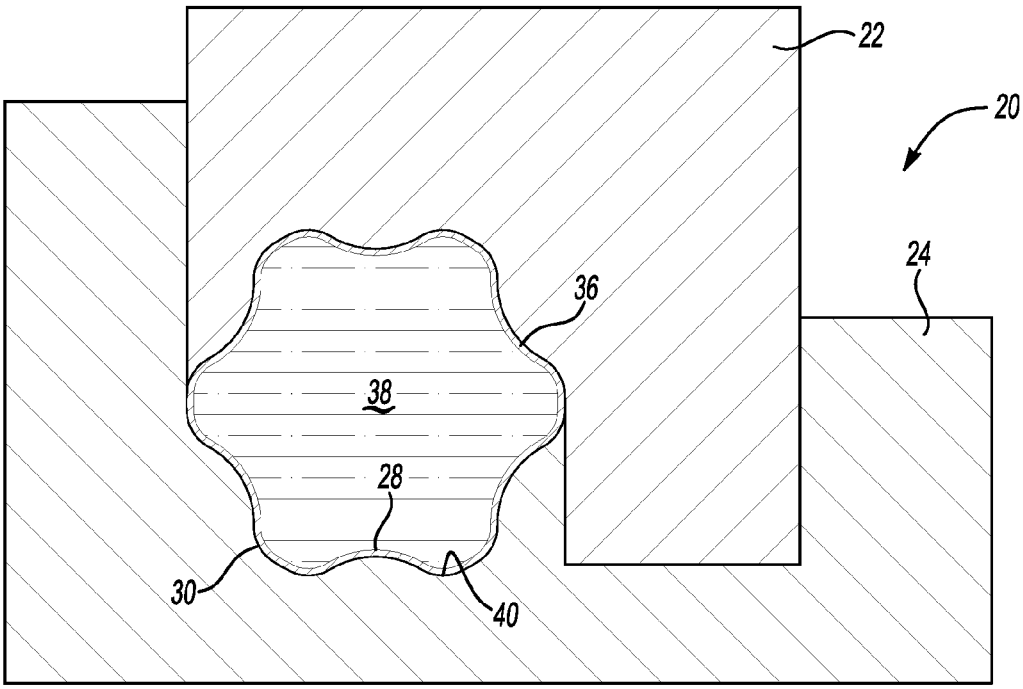
FIG. 4 is a diagrammatic cross-sectional view of a preforming die showing the preliminary preform after hydro-forming into the shape of a fully preformed tube.

Referring to FIG. 4, the preliminary preform 32 is formed into a preformed tube 36 by a fluid 38 that is supplied within the preliminary preform 32. Hydro-forming pressure is provided to the fluid 38 to cause the preformed tube 36 to be formed against the forming surface 40 of the preform die set 20.

Figure 5:
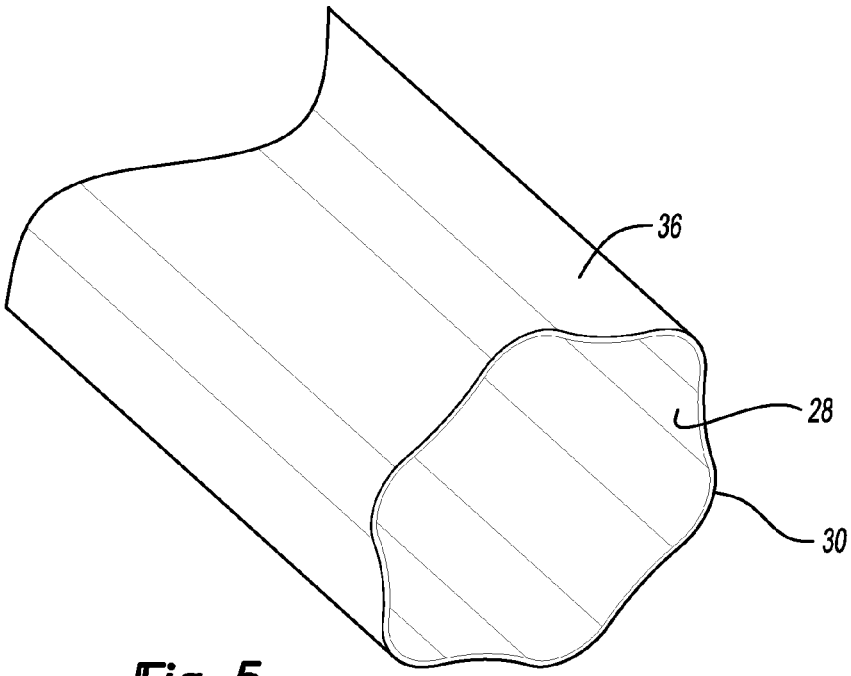
FIG. 5 is a fragmentary perspective view of the fully preformed tube.

Referring to FIG. 5, the preformed tube 36 is shown after being removed from the preformed die set 20 shown in FIG. 4. The preformed tube 36 includes convex nodes 28 and concave nodes 30 that may alternate about the periphery of the preformed tube 36.

Figure 6:
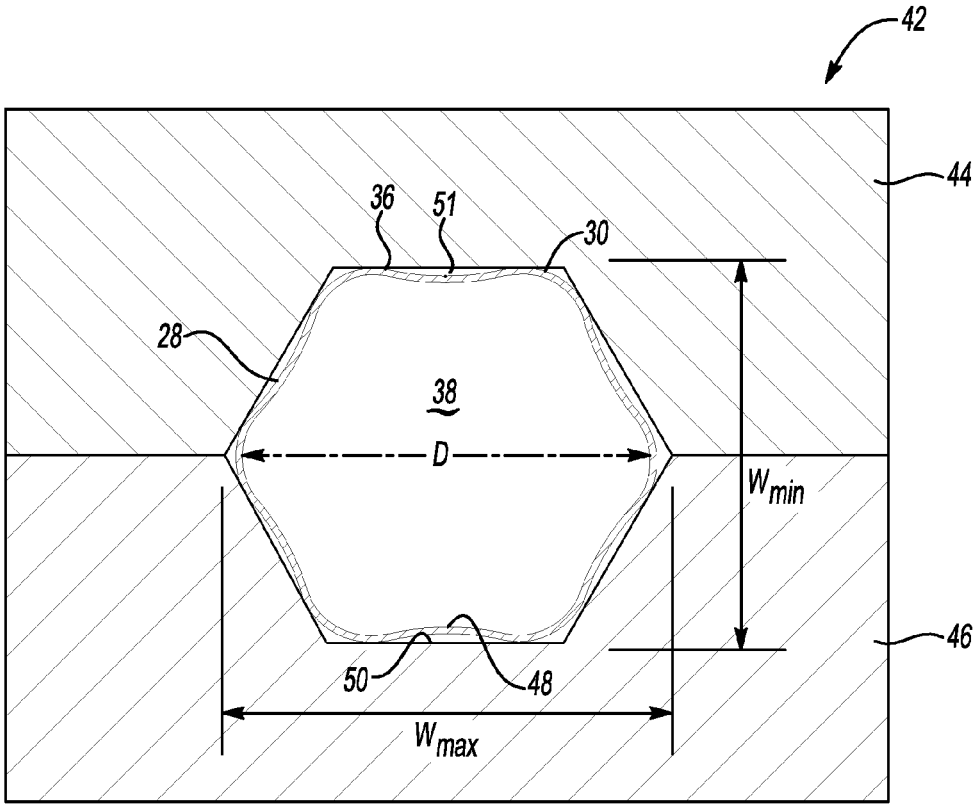
FIG. 6 is a diagrammatic cross-sectional view of a preformed tube filled with a fluid and disposed in a final shape die prior to the final hydro-forming step.
Figure 7:
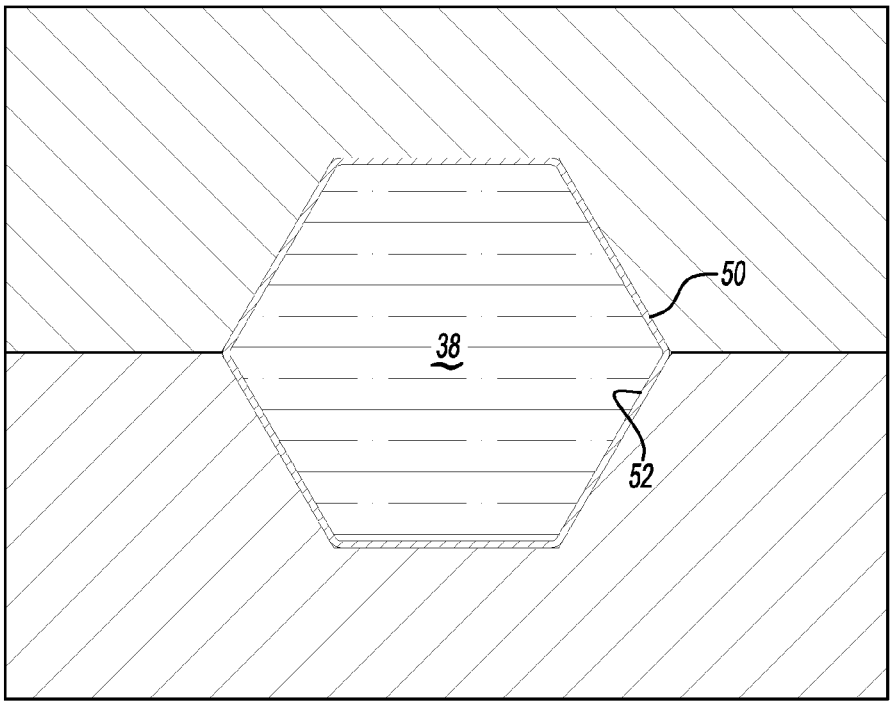
FIG. 7 is a diagrammatic cross-sectional view of a hydro-formed final part in the final hydro-forming die after the final part shape is formed by internal pressure.

Referring to FIGS. 6-7, a preformed tube is shown in FIG. 6 that is disposed in a final hydro-forming die set 42. The hydro-forming die set includes an upper die 44 and a lower die 46. Fluid 38 is provided within the preformed tube 36. Excess metal areas 48 that correspond to the convex nodes 28 and windows of predicted low strain 18, as shown in FIG. 1, are provided within the preformed tube 36. The final die forming surface 50 is defined by the upper die 44 and the lower die 46. Clearance 51 is provided between the excess metal areas 48 and the final die forming surface 50. The concave nodes 30 generally extend across corners 16 formed in the final die forming surface 50 and are in contact with the final die forming surface 50. The fluid 38 in the preformed tube 36 is subjected to hydro-forming pressure forming to form the preformed tube 36 into the final part 52.

Referring to FIG. 7, the final part 52 is shown fully expanded after hydro-forming in contact with the final die forming surface 50. After forming by the fluid 38, the fluid 38 is drained from the final part 52.

Figure 8:
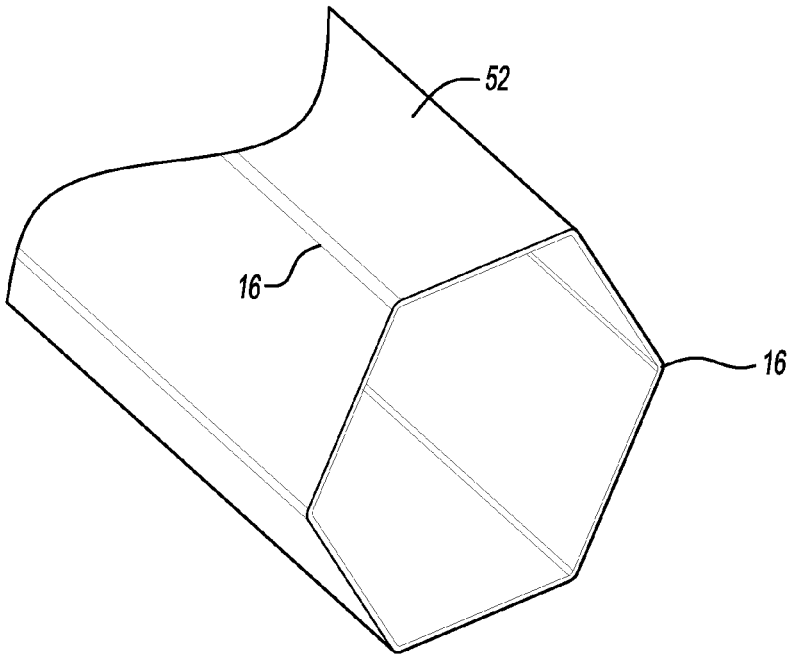
FIG. 8 is a fragmentary perspective view of the final part.

As shown in FIG. 8, the final part 52 is formed with a plurality of corners 16.

Another aspect of Applicant's development is to provide a method of hydro-forming an elongated tubular member that has areas of predicted higher strain 12 and areas of predicted lower strain 18. According to the method, as shown in FIG. 1, the tube 26 is compressed radially in areas of predicted low strain 18 to form the preliminary preform 32 in the preform die set 20. The preform die set 20 is the illustrated embodiment functioning as a compression apparatus when it closes upon the tube 26. The preliminary preform 32 is then hydro-formed into the preformed tube 36. Subsequently, the preformed tube 36 is hydro-formed in the final die set 42 into the final part 52.

The areas of predicted low strain 18 are adjacent to areas of predicted higher strain 12 that generally extend the length of the elongated tubular member 26. During the step of deforming the tube 26, a quantity of metal is stretched from the areas of predicted low strain 18. During the hydro-forming step, the preformed tube 36 is hydro-formed into the final part shape 52 with at least a portion of the quantity of metal preformed into the predicted areas of low strain 18 being stretched into the areas of predicted high strain 12. During the step of deforming the preliminary preform 32, the clearance space 51 is provided between the preliminary preform 32 and an inner surface of the preform die set 20. Subsequently, during the step of hydro-forming the preliminary preform 32, the preliminary preform 32 is expanded in a hydro-forming operation to fill the clearance space 51.

Applicant's development also relates to a method of hydro-forming a tubular part 52 to have at least one corner 16 that extends lengthwise relative to the length of the tubular part 52. As shown in FIG. 6, the tubular part 52 has a width that is measured between two opposite sides of $W_{min}$ in a minimum width area and a width $W_{max}$ in a maximum width area. The method of hydro-forming the tubular part 52 begins by selecting a metal tube 26 that has a circular cross-section with a diameter D that is greater than $W_{min}$. The tube 26 is formed in the preform die set 20 to mechanically compress the outer diameter of the tube at least one localized area of low strain that extends lengthwise along the tube. The localized area is adjacent to a high strain area that is next to a corner area of the part. The preliminary preform 32 has an outer surface that is compressed to less than $W_{min}$. The preliminary preform 32 is hydro-formed in a first hydro-forming operation in the preform die set 20 to form the preform 36. The preform 36 is then removed from the preform die set 20 and loaded into the final die set 42. A second hydro-forming operation is used to hydro-form the preform 36 in the final die set 42 to form the corner 16 in the tube. The localized area of high strain 12 may be adjacent to opposite sides of the corner 16.

Applicant has also developed a method of designing a set of dies for hydro-forming a tube. The method of designing a set of dies includes the first step of developing a model of a final part shape to collect data corresponding to the distribution of strains in the tube after theoretically, or actually testing the forming process in a single step hydro-forming process.

A finite element procedure with a fine numerical mesh without remeshing may be used in simulating a one-step hydro-forming process to determine areas of over-stretching 12 and areas of under stretching 18 in the initial tube. The predicted locations of under-stretching 18 and over-stretching 12 may be learned based upon analysis of the finite element values observed after the hydro-forming process.

The next step in the process is to develop the shape of the preform following the preform step. The preform is designed to be unfolded from the preform shape to the final shape without any substantial stretching.

A target preform shape is developed as follows:

(1) The strains from the single step hydro-forming process are allocated in the non-deformed tube by assigning numeric values of strains in each finite element of the non-deformed tube that it would have at the end of the hydro-forming process. Stresses in each finite of the non-deformed tube element are calculated based upon elastic equations connecting stresses and strains.

(2) Deformation of the tube having internal stresses calculated in (1) above is simulated with boundary conditions corresponding to rigid inner and outer mandrels that are designed to prevent the tube from buckling. Windows are defined on the inner mandrel into which material is designed to flow as driven by the internal stresses in the tube. At the end of the simulation process, elastic stresses are balanced and provide a lower strain level during final shape hydro-forming by providing bulges of metal in the designated windows defined as under stretched areas.

(3) The preformed shape is validated by designing the forming surface of the preform die to have the shape of the bulges developed in the elastic bulging model. A simulation is developed for the deformation of the tube as a result of closing the punch 22 and lower die 24, hydro-forming the preliminary preform 32 to conform to the die surface 40, and hydro-forming the preform tube 36 to the final part 52.

(4) The predicted strains in the final part 52 are analyzed to determine if the strain distribution is acceptable. If the maximum strain is above the forming limit, the finite element mesh is assigned to the final part shape that is then deformed back towards the preform tube 36 by iteratively identifying the distribution of the nodal forces. No initial strains are applied to the finite element mesh during this step. Elastic formulation of the model is used to ensure that the surface of the final shape of the tube is essentially the same quantitatively as the shape of the preform. The nodal forces are assigned, so that the shape of the preformed tube is similar to the shape of the tube developed in (2) above. Iterative readjustment of the nodal force distribution allows for smoothing the surface to maintain equivalence between the preformed shape and the final shape.

(5) The strain distribution is rechecked as in step (3) above and repeated if necessary.

Predicted under-stretched areas 18 and predicted over-stretched areas 12 are identified in the model, as they are expected to be formed during the single step hydro-forming process. The preforming die set 20 is then designed based upon the model to provide the predicted under-stretched areas 18 with pockets during a preforming step. The final hydro-forming die set 42 is designed to the final shape.

The method of designing a set of dies for hydro-forming a tube may also include the further step of designing the preforming die set 20 that compresses the tube to stretch metal in under-stretched areas 18 to form the preliminary preform 32. The preliminary preform 32 is expanded in the hydro-forming die by injecting pressurized fluid 38 into the tube to form the preformed tube 36. The clearance space 51 is preferably provided between the preliminary preform 32 and the concave areas of the die surface 40 on the inner surface of the preform die set 20. During the first hydro-forming step, the preliminary preform 32 is expanded to fill the clearance space 51 between the preliminary preform 32 and the inner surface of the preform die set 20. The predicted over-stretched areas 12 are generally adjacent to corner areas and the predicted under-stretched areas 18 may be flat areas that are adjacent to the over-stretched areas 12.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A method of hydro-forming an elongated tubular member that has areas of predicted high strain and areas of predicted low strain, comprising:

stretching the tube by deforming the tube radially in the areas of predicted low strain in to a preliminary preform in a preform die;

hydro-forming the preliminary preform in a first hydro-forming operation into a preformed tube; and hydro-forming the preformed tube in a second hydro-forming operation in a final die into a final shape.

2. The method of claim 1 wherein the areas of predicted low strain extend along the length of the elongated tubular member and are adjacent to the areas of predicted high strain.

3. The method of claim 1 wherein during the step of deforming the tube a quantity of metal is deformed in the areas of predicted low strain.

4. The method of claim 3 wherein during the step of hydro-forming the preformed tube into a final shape at least a portion of the quantity of metal from the predicted areas of low strain is drawn into the areas of predicted high strain.

5. The method of claim 1 wherein during the step of deforming the preliminary preform a clearance space is defined between the preliminary preform and an inner surface of the preform die.

6. The method of claim 5 wherein during the step of hydro-forming the preliminary preform the preliminary preform is expanded to fill the clearance space.

7. A method of hydro-forming a tubular part to have at least one corner that is to be formed in a corner area extending in a lengthwise direction relative to the tubular part, the tubular part having a width as measured between two opposed sides of $W_{min}$ in a minimum width area and of $W_{max}$ in a maximum width area, the method comprising the steps of:

selecting a metal tube that has a circular cross-section with a diameter D that is greater than $W_{min}$;

forming the tube in a preform die to mechanically compress the outer diameter of the tube in at least one localized area that extends lengthwise along the tube and is adjacent to the corner area to form a preliminary preform, wherein the outer surface of the tube is compressed to less than $W_{min}$;

hydro-forming the preliminary preform in a first hydro-forming operation in the preform die to form a preformed tube;

removing the preformed tube from the preform die;

loading the preformed tube into a final die; and hydro-forming the preformed tube in a second hydro-forming operation in the final die to form the corner in the tube.

8. The method of claim 7 wherein the at least one localized area includes two localized areas that are adjacent to the at least one corner area.

9. The method of claim 7 wherein a clearance space is provided between the preliminary preform and an inner surface of the preform die.

10. The method of claim 9 wherein during the step of hydro-forming the preliminary preform in a first hydro-forming operation the preliminary preform is expanded to fill the clearance space.

11. A method of designing a set of dies for hydro-forming a tube comprising:

developing a model of a final part to collect data corresponding to the distribution of strains in the tube after forming in a theoretical single step hydro-forming process;

identifying in the model predicted under-stretched areas and predicted over-stretched areas that are expected to be formed during the theoretical single step hydro-forming process;

designing a preforming die set based upon the model to provide stretching of the predicted under-stretched areas to the designated level of strain; and designing a final hydro-forming die set based upon the model in which the extra metal in the predicted under-stretched areas of the tube is drawn into predicted over-stretched areas.

12. The method of designing a set of dies for hydro-forming a tube of claim 11 wherein the step of designing a preforming die set includes:

designing a compression apparatus that compresses the tube by deforming the under-stretched areas to form a preliminary preform; and designing a hydro-forming die in which the preliminary preform is expanded by injecting pressurized fluid into the tube to form a preformed tube into the final part.

13. The method of designing a set of dies for hydro-forming a tube of claim 12 wherein the step of designing the compression apparatus includes incorporating the compression apparatus in the hydro-forming die in which the preliminary preform is expanded.

14. The method of designing a set of dies for hydro-forming a tube of claim 12 wherein a clearance space is provided between the preliminary preform and an inner surface of the preform die.

15. The method of claim 14 wherein during the preliminary preform is expanded to fill the clearance space.

16. The method of designing a set of dies for hydro-forming a tube of claim 11 wherein the predicted over-stretched areas are adjacent to a corner and the predicted under-stretched areas are a pair of flats that are adjacent to the predicted over-stretched areas.

* * * * *